US006123197A

United States Patent [19]

Marquez et al.

[11] Patent Number: 6,123,197

[45] Date of Patent: Sep. 26, 2000

[54] GIFT WRAPPING STORAGE CONTAINER

[76] Inventors: Janie M. Marquez; Arturo Marquez, both of 9191 Elk Grove Blvd. #30, Elk Grove, Calif. 95624

[21] Appl. No.: 09/494,370

[22] Filed: Jan. 31, 2000

[51] Int. Cl.[7] ..... B65D 85/00

[52] U.S. Cl. ..... 206/575; 206/225

[58] Field of Search ..... 206/216, 223, 206/575, 225, 389, 372, 373

[56] References Cited

U.S. PATENT DOCUMENTS 4,989,734 2/1991 Mode et al. ..... 206/575

5,522,507 6/1996 Cruz ..... 206/575

*Primary Examiner*—Jacob K. Ackun

[57] ABSTRACT

A gift wrapping storage container for storing wrapping paper and gift wrapping accessories. The gift wrapping storage container includes a container that has a front side, a back side, first and second sides extending between the front and back sides, a bottom, and an open top. The sides and bottom define an interior of the container that is adapted to vertically receive rolls of wrapping paper. A lid is hingedly coupled to the back side of the container to close the open top. Each of the sides has an inner surface and an outer surface. The outer surface of one of the sides has a bag hook that is removably coupled thereto and is adapted to receive a handle of a bag. A tray member for holding wrapping accessories such as scissors, bows, tape, ribbon, writing instruments is removably disposable in the interior of the container and rests on support flanges that extend from the inner surfaces of the first and second sides.

20 Claims, 3 Drawing Sheets

GIFT WRAPPING STORAGE CONTAINER

BACKGROUND OF THE INVENTION

1. Field of the Invention

The present invention relates to gift wrap organizers and more particularly pertains to a new gift wrapping storage container for storing wrapping paper and gift wrapping accessories.

2. Description of the Prior Art

The use of gift wrap organizers is known in the prior art. More specifically, gift wrap organizers heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. Nos. 3,321,259; 4,186,833; 2,482,714; U.S. Pat. Nos. Des. 376,940; 361,225; and U.S. Pat. No. Des. 341,776.

While these devices fulfill their respective, particular objectives and requirements, the aforementioned patents do not disclose a new gift wrapping storage container. The inventive device includes a container that has a front side, a back side, first and second sides extending between the front and back sides, a bottom, and an open top. The sides and bottom define an interior of the container that is adapted to vertically receive rolls of wrapping paper. A lid is hingedly coupled to the back side of the container to close the open top. Each of the sides has an inner surface and an outer surface. The outer surface of one of the sides has a bag hook that is removably coupled thereto and is adapted to receive a handle of a bag. A tray member for holding wrapping accessories such as scissors, bows, tape, ribbon, cards, writing instruments is removably disposable in the interior of the container and rests on support flanges that extend from the inner surfaces of the first and second sides.

In these respects, the gift wrapping storage container according to the present invention substantially departs from the conventional concepts and designs of the prior art, and in so doing provides an apparatus primarily developed for the purpose of storing wrapping paper and gift wrapping accessories.

SUMMARY OF THE INVENTION

In view of the foregoing disadvantages inherent in the known types of gift wrap organizers now present in the prior art, the present invention provides a new gift wrapping storage container construction wherein the same can be utilized for storing wrapping paper and gift wrapping accessories.

The general purpose of the present invention, which will be described subsequently in greater detail, is to provide a new gift wrapping storage container apparatus and method which has many of the advantages of the gift wrap organizers mentioned heretofore and many novel features that result in a new gift wrapping storage container which is not anticipated, rendered obvious, suggested, or even implied by any of the prior art gift wrap organizers, either alone or in any combination thereof.

To attain this, the present invention generally comprises a container that has a front side, a back side, first and second sides extending between the front and back sides, a bottom, and an open top. The sides and bottom define an interior of the container that is adapted to vertically receive rolls of wrapping paper. A lid is hingedly coupled to the back side of the container to close the open top. Each of the sides has an inner surface and an outer surface. The outer surface of one of the sides has a bag hook that is removably coupled thereto and is adapted to receive a handle of a bag. A tray member for holding wrapping accessories such as scissors, bows, tape, ribbon, cards, writing instruments is removably disposable in the interior of the container and rests on support flanges that extend from the inner surfaces of the first and second sides.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new gift wrapping storage container apparatus and method which has many of the advantages of the gift wrap organizers mentioned heretofore and many novel features that result in a new gift wrapping storage container which is not anticipated, rendered obvious, suggested, or even implied by any of the prior art gift wrap organizers, either alone or in any combination thereof.

It is another object of the present invention to provide a new gift wrapping storage container which may be easily and efficiently manufactured and marketed.

It is a further object of the present invention to provide a new gift wrapping storage container which is of a durable and reliable construction.

An even further object of the present invention is to provide a new gift wrapping storage container which is susceptible of a low cost of manufacture with regard to both materials and labor, and which accordingly is then susceptible of low prices of sale to the consuming public, thereby making such gift wrapping storage container economically available to the buying public.

Still yet another object of the present invention is to provide a new gift wrapping storage container which provides in the apparatuses and methods of the prior art some of the advantages thereof, while simultaneously overcoming some of the disadvantages normally associated therewith.

Still another object of the present invention is to provide a new gift wrapping storage container for storing wrapping paper and gift wrapping accessories.

Yet another object of the present invention is to provide a new gift wrapping storage container which includes a container that has a front side, a back side, first and second sides extending between the front and back sides, a bottom, and an open top. The sides and bottom define an interior of the container that is adapted to vertically receive rolls of wrapping paper. A lid is hingedly coupled to the back side of the container to close the open top. Each of the sides has an inner surface and an outer surface. The outer surface of one of the sides has a bag hook that is removably coupled thereto and is adapted to receive a handle of a bag. A tray member for holding wrapping accessories such as scissors, bows, tape, ribbon, cards, writing instruments is removably disposable in the interior of the container and rests on support flanges that extend from the inner surfaces of the first and second sides. An interior bag holder may also be included, one side of which has three bag slots.

Still yet another object of the present invention is to provide a new gift wrapping storage container that protects gift wrapping supplies from dust and crushing.

Even still another object of the present invention is to provide a new gift wrapping storage container that has a removable tray for more convenient transporting of gift wrapping supplies, especially when wrapping gifts away from home.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
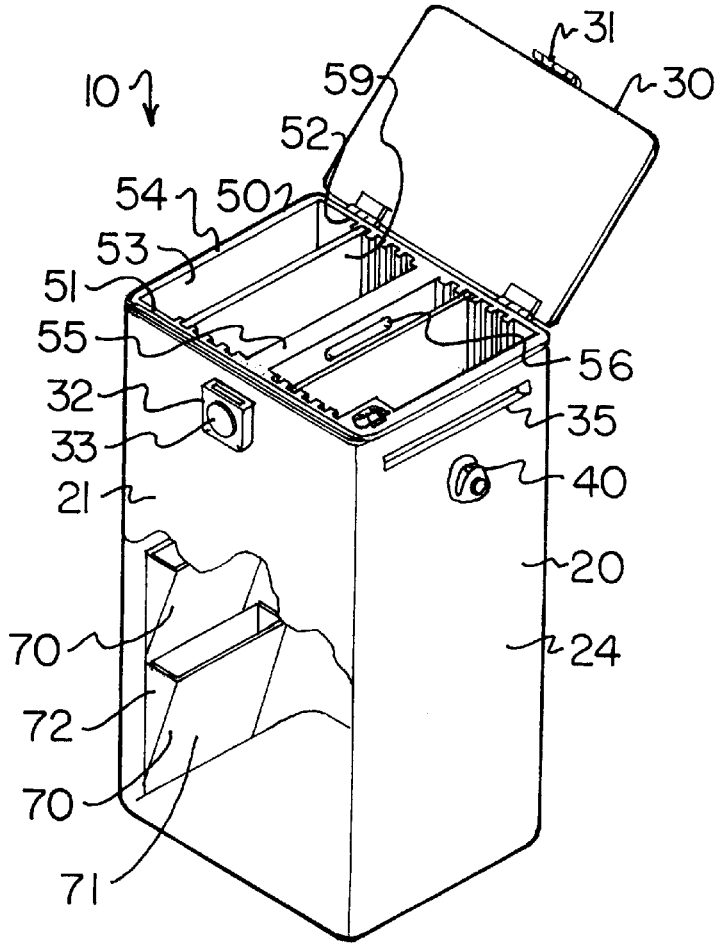
FIG. 1 is a schematic perspective view of a new gift wrapping storage container according to the present invention.
Figure 2:
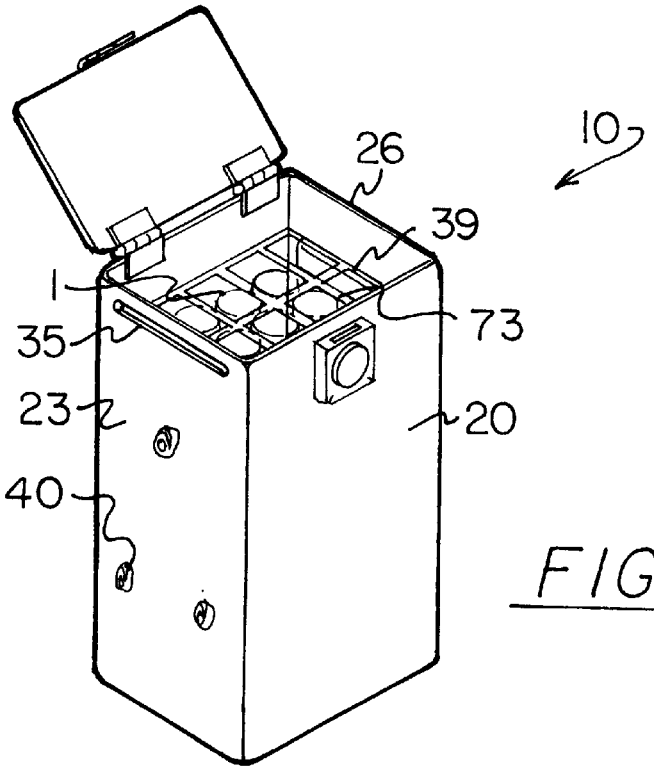
FIG. 2 is a schematic perspective view of the present invention.

With reference now to the drawings, and in particular to FIGS. 1 through 8 thereof, a new gift wrapping storage container embodying the principles and concepts of the present invention and generally designated by the reference numeral 10 will be described.

As best illustrated in FIGS. 1 through 8, the gift wrapping storage container 10 generally comprises a generally rectangular container 20 that has a front side 21, a back side 22, first and second sides 23,24 that extend between the front and back sides 21,22, a bottom 25, and an open top 26. The sides and bottom 25 define an interior of the container 20 that is adapted to vertically receive rolls of wrapping paper 1. Preferably, the corners of the container 20 are rounded for safety.

A lid 30 is hingedly coupled to the back side 22 of the container 20 to close the open top 26. Preferably, the lid 30 has a flange 31 that extends 53 from it. The front side 21 of the container 20 has a latch coupled to it. The latch slidably receives the flange 31 of the lid 30 for locking the lid 30 in a closed orientation. Ideally, the latch releases the flange 31 when a button 33 is pushed.

Each of the sides 21–24 of the container 20 has an inner surface and an outer surface. Preferably, each of the outer surfaces of the first and second sides 23,24 has an elongate handle channel 35 extending therein. Ideally, the handle channels 35 are positioned towards the open top 26 of the container 20 to permit placement of a user's thumbs on the lid 30 to permit lifting of the container 20 and positioning it from a vertical orientation towards a horizontal orientation while suspended. This would be useful when lifting the container 20 from a vertical position on the floor to place the container 20 in a horizontal position, such as in the back seat of a car. A user would simply twist his hands back towards himself or herself, swinging the bottom 25 of the container 20 upwards such that the container 20 moves towards a horizontal position.

The outer surface of one of the sides has a bag hook 40 that is removably coupled to it. The bag hook 40 is adapted to receive a handle of a bag 2.

Preferably, the outer surface of the first side 23 of the container 20 has a plurality of coupling means (not shown) such as snaps that are attached thereto and a plurality of bag hooks 40 that are removably coupled to the coupling means (not shown). Also preferably, the outer surface of the second side 24 has a coupling means (not shown) that is attached to it and a bag hook 40 that is removably coupled to the coupling means(not shown). Ideally, the bag hook 40 of the second side 24 is of a larger size than the bag hooks 40 of the first side 23 so that it can receive larger sized bags 2.

Figure 4:
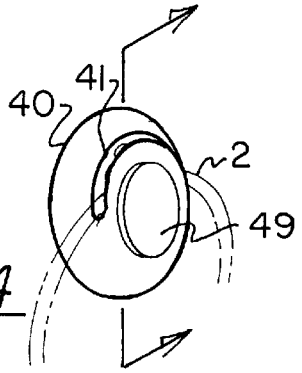
FIG. 4 is a schematic perspective view of a bag hook of the present invention.
Figure 5:
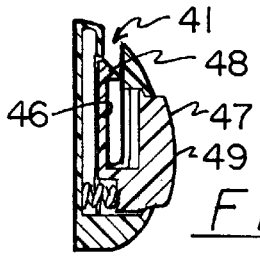
FIG. 5 is a schematic cross-sectional view of a bag hook of the present invention taken from line 5—5 of FIG. 4.
Figure 6:
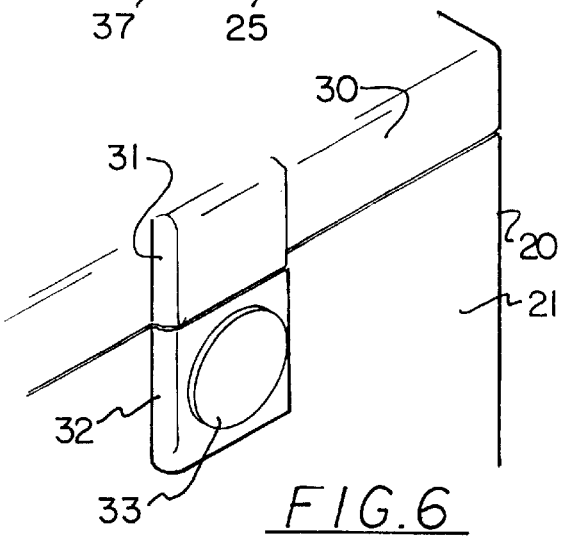
FIG. 6 is a schematic detailed perspective view of a lid latch of the present invention.
Figure 7:
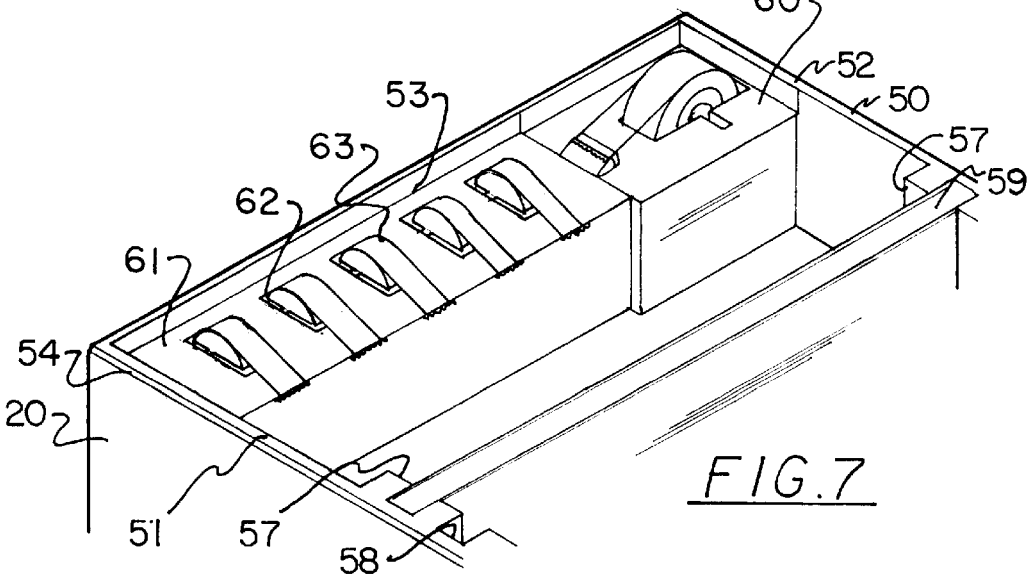
FIG. 7 is a schematic detailed perspective view of the present invention.
Figure 8:
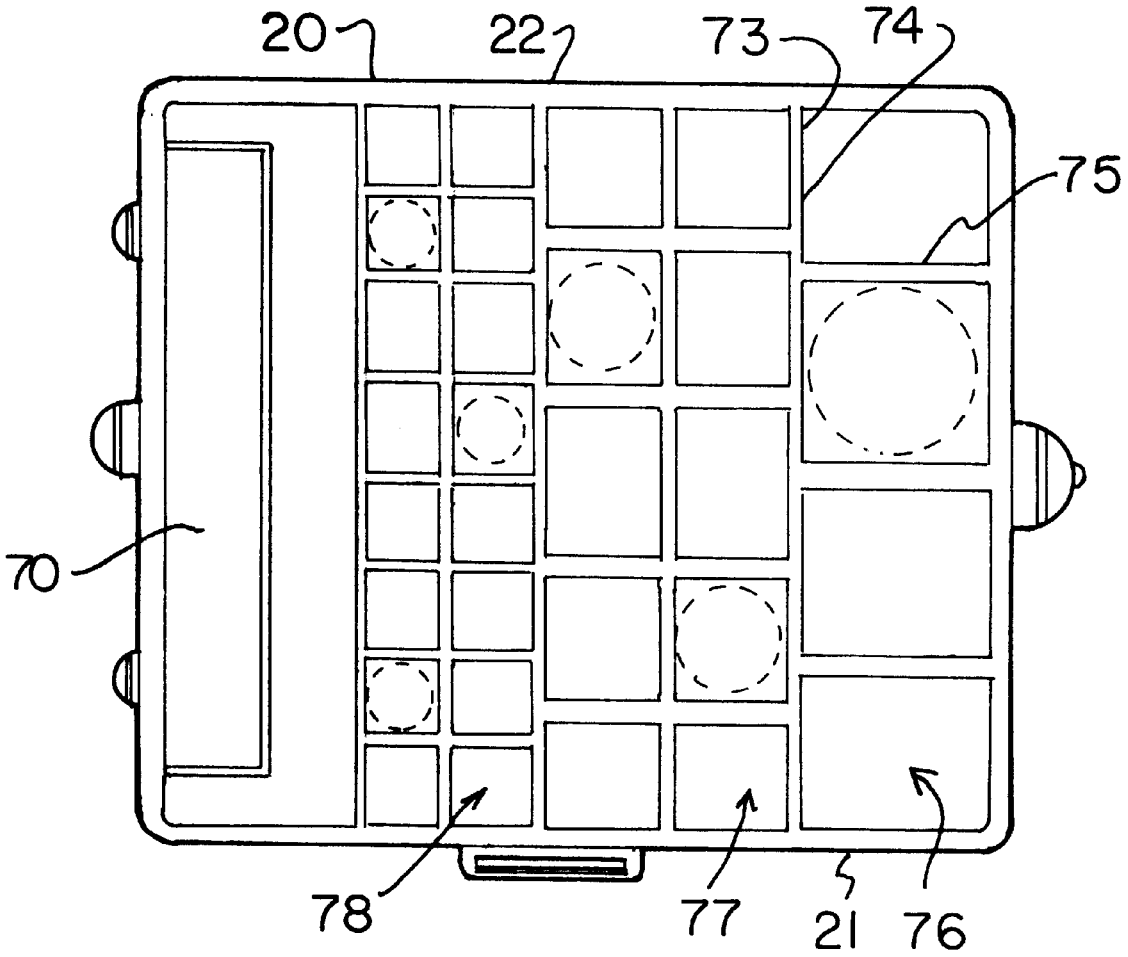
FIG. 8 is a schematic top view of the present invention.

Preferably, as illustrated in FIGS. 4 and 5, each of the bag hooks 40 is generally circular and has a handle receiving channel 41 extending into it that is adapted to receive a handle or handles of a bag 2 or bags.

Ideally, each of the handle receiving channels 41 of the bag hooks 40 has a generally U-shaped clip 45 for locking the handle of the bag 2 in the handle receiving channel 41. In an exemplary embodiment, each of the clips 45 has an inner finger portion 46 and an outer finger portion 47. The inner finger portion 46 has a flange 48 that extends towards the outer finger portion 47. The outer finger portion 47 forms a bag release button 49 and extends through an aperture in the bag hook 40. Each of the clips 45 is positionable between a locked position and an unlocked position. The flanges 48 extend into the handle receiving channels 41 when the clips 45 are in the locked position. The flanges 48 are recessed from the handle receiving channels 41 when the clips 45 are in the unlocked position. Each of the clips 45 is biased towards a locked position. Depressing the bag release buttons 49 of the clip 45 moves the clips 45 from a locked position towards an unlocked position.

Preferably, as shown in FIG. 1, the inner surface of the first side has a plurality of receptacles 70 coupled to it. Ideally, three receptacles are provided. Each of the receptacles has a panel 71 extending from the inner surface of the first side towards the open top of the container at an acute angle with respect to a plane extending along the first side. Each of the receptacles has a pair of generally triangular sidewalls 72 extending between the first side and the panel. Bags may be placed inside the receptacles.

Also preferably, a rack 73 is disposed in the interior of the container. The rack has a plurality of first bars 74 extending between the front and back sides of the container and a plurality second bars 75 extending generally perpendicularly to the first bars. The bars of the rack define a plurality of apertures through which rolls of wrapping paper may be inserted to help keep them organized.

Ideally, a first portion 76 of the apertures are a first size, a second portion 77 of the apertures are larger than the first apertures, and a third portion 78 of the apertures are larger than the second apertures. Also ideally, the rack is positioned below the support flanges 39 so that the rolls of wrapping paper are easier to grasp.

Figure 3:
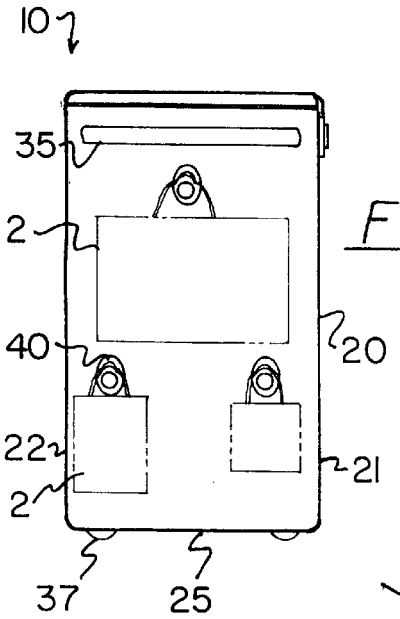
FIG. 3 is a schematic side view of the present invention.

Also preferably, as shown in FIG. 3, the bottom 25 of the container 20 has a plurality of wheels 37 extending from it. The wheels 37 permit easier movement of the gift wrapping storage container 10.

A tray member 50 for holding wrapping accessories such as scissors, bows, tape, ribbon, cards, and writing instruments is removably disposable in the interior of the container 20. The tray member 50 has forward and rearward sides 51,52 and a pair of ends 53 that extend between the forward and rearward sides 51,52.

Preferably, each of the inner surfaces of the first and second sides 23,24 of the container 20 has a support flange 39 extending from it. The tray member 50 rests on the support flanges 39 of the first and second sides 23,24. Alternatively, the upper edge of the tray member 50 may have a flange 54 extending around the perimeter of the tray member 50 that rests on the upper edges of the sides 21–24 of the container 20.

Also preferably, the tray member 50 has a cross member 55 that extends 53 between the forward and rearward sides 51,52 and is positioned centrally between the ends 53 of the tray member 50. The cross member 55 has an elongate handle slot 56 extending through it. Ideally, the cross member 55 is tall enough that it abuts the lid 30 when the lid 30 is closed to prevent objects from passing from side to side of the tray member 50 as it is moved about or laid on its side.

Preferably, the forward and rearward sides 51,52 of the tray member 50 have a plurality of alternating ridges 57 and slots 58. The tray member 50 has a plurality of spacers 59 that are slidably received in the slots 58 of the forward and rearward sides 51,52 of the tray member 50. The spacers 59 are used to form spaces of varying volumes in the tray member 50.

Also preferably, a tape dispenser 60 is removably disposed in the tray member 50. A ribbon dispenser 61 may also be removably disposed in the tray member 50. Ideally, the ribbon dispenser 61 has a plurality of ribbon dispensing slots 62 extending through an upper surface of the ribbon dispenser 61. The ribbon dispenser 61 has an interior and a plurality of rolls of ribbon 63 that are disposed in the interior of the ribbon dispenser 61. The ribbon extends through the ribbon dispensing slots 62.

In an exemplary embodiment, all of the sides of the container 20 are generally rectangular. The vertical length of the sides of the container 20 is between about 24 and 60 inches. The horizontal width of the front and back sides 21,22 is between about 6 and 36 inches. The horizontal width of the first and second sides 23,24 is between about 6 and 36 inches.

In the preferred embodiment, the vertical length of the sides 21–24 of the container 20 is about 39 inches, the horizontal width of the front and back sides 21,22 is about 20 inches, and the horizontal width of the first and second sides 23,24 is about 18 inches. The vertical height of the tray member 50 would be about 3 inches to sit just above a 36 inch wide roll of wrapping paper.

In use, rolls of wrapping paper 1 are inserted vertically in the interior of the container 20. Gift wrapping accessories are placed in the tray member 50. The tray member 50 is placed in the interior of the container 20 over the rolls of paper 1 and the lid 30 closed and latched and the gift wrapping storage container 10 is stored. When the need to wrap gifts arises, the lid 30 is opened and the tray member 50 removed to expose the rolls of paper 1. Bags 2 may be hung on the bag hooks 40. Bag hooks 40 coupled to the coupling means of the outer surfaces of the first and second sides 23,24 may also be detached from the coupling means and attached to the coupling means on the inner surfaces of the sides 21–24.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A storage container for gift wrapping supplies, comprising:

a container having a front side, a back side, first and second sides extending between the front and back sides, a bottom, and an open top, the sides and bottom defining an interior of the container being adapted for vertically receiving rolls of wrapping paper;

a lid being hingedly coupled to said back side of said container, said lid closing said open top;

each of said sides having an inner surface and an outer surface, said outer surface of one of said sides having a bag hook being removably coupled thereto and being adapted for receiving a handle of a bag.

2. The storage container of claim 1, wherein said lid has a flange extending therefrom, said front side of said container having a latch coupled thereto for locking said lid in a closed orientation, said latch slidably receiving said flange of said lid.

3. The storage container of claim 1, wherein each of said outer surfaces of said first and second sides has an elongate handle channel extending therein, said handle channels being positioned towards said open top of said container.

4. The storage container of claim 1, wherein said outer surface of said second side has a coupling means being attached thereto, said bag hook being removably coupled to said coupling means.

5. The storage container of claim 4, wherein said outer surface of said first side has a plurality of coupling means being attached thereto and a plurality of bag hooks being removably coupled to said coupling means.

6. The storage container of claim 1, wherein said bag hook is generally circular and has a handle receiving channel extending therein.

7. The storage container of claim 6, wherein said handle receiving channel of said bag hook has a generally U-shaped clip for locking the handle of the bag in the handle receiving channel.

8. The storage container of claim 7, wherein said clip has an inner finger portion and an outer finger portion, said inner finger portion having a flange extending towards said outer finger portion, said outer finger portion forming a bag release button and extending through an aperture in said bag hook, wherein said clip is positionable between a locked position and an unlocked position, said flange extending into said handle receiving channel when said clip is in said locked position, said flange being recessed from said handle receiving channel when said clip is in said unlocked position, said clip being biased towards a locked position, wherein depressing said bag release button of said clip moves said clip from a locked position towards an unlocked position.

9. The storage container of claim 1, wherein at least one inner surface of one of a side of said container has a coupling means being attached thereto for removably coupling said bag hook thereto.

10. The storage container of claim 1, wherein said bottom of said container has a plurality of wheels extending therefrom.

11. The storage container of claim 1, further comprising a tray member being removably disposable in said interior of said container, said tray member having forward and rearward sides and a pair of ends extending between the forward and rearward sides.

12. The storage container of claim 11, wherein each of said inner surfaces of said first and second sides of said container has a support flange extending therefrom, said tray member resting on said support flanges of said first and second sides.

13. The storage container of claim 11, wherein said tray has a cross member extending between said forward and rearward sides and being positioned centrally between said ends, said cross member having an elongate handle slot extending therethrough.

14. The storage container of claim 11, wherein said forward and rearward sides of said tray member have a plurality of alternating ridges and slots, said tray member having a plurality of spacers being slidably received in said slots of said forward and rearward sides of said tray member.

15. The storage container of claim 11, further comprising a tape dispenser being removably disposed in said tray member.

16. The storage container of claim 11, further comprising a ribbon dispenser being removably disposed in said tray member, said ribbon dispenser having a plurality of ribbon dispensing slots extending through an upper surface thereof, said ribbon dispenser having an interior and a plurality of rolls of ribbon being disposed in said interior of said ribbon dispenser, said ribbon being extended through said ribbon dispensing slots.

17. The storage container of claim 1, wherein an inner surface of one of said sides has a plurality of receptacles coupled thereto, each of said receptacles having a panel extending from said inner surface of said first side towards said open top of said container at an acute angle with respect to a plane extending along said first side, each of said receptacles having a pair of generally triangular sidewalls extending between said first side and said panel.

18. The storage container of claim 1, further comprising a rack being disposed in said interior of said container, said rack having a plurality of first bars extending between said front and back sides of said container and a plurality second bars extending generally perpendicularly to said first bars, said bars of said rack defining a plurality of apertures, said rack being adapted for helping keep said rolls of wrapping paper organized.

19. The storage container of claim 18, wherein a first portion of said apertures are a first size, a second portion of said apertures being larger than said first apertures, a third portion of said apertures being larger than said second apertures.

20. A storage container for gift wrapping supplies, comprising:

a generally rectangular container having a front side, a back side, first and second sides extending between the front and back sides, a bottom, and an open top, the sides and bottom defining an interior of the container being adapted for vertically receiving rolls of wrapping paper;

a lid being hingedly coupled to said back side of said container, said lid closing said open top, said lid having a flange extending therefrom;

said front side having a latch coupled thereto for locking said lid in a closed orientation, said latch slidably receiving said flange of said lid;

each of said sides having an inner surface and an outer surface, each of said outer surfaces of said first and second sides having an elongate handle channel extending therein, said handle channels being positioned towards open top of said container;

said outer surface of said first side having a plurality of coupling means being attached thereto and a plurality of bag hooks being removably coupled to said coupling means;

said outer surface of said second side having a coupling means being attached thereto and a bag hook being removably coupled to said coupling means;

wherein each of said bag hooks is generally circular and has a handle receiving channel extending therein adapted for receiving a handle of a bag;

each of said handle receiving channels of said bag hooks having a generally U-shaped clip for locking the handle of the bag in the handle receiving channel;

each of said clips having an inner finger portion and an outer finger portion, said inner finger portion having a flange extending towards said outer finger portion, said outer finger portion forming a bag release button and extending through an aperture in said bag hook;

wherein each of said clips is positionable between a locked position and an unlocked position, said flanges extending into said handle receiving channels when said clips are in said locked position, said flanges being recessed from said handle receiving channels when said clips are in said unlocked position, each of said clips being biased towards a locked position, wherein depressing said bag release buttons of said clip moves said clips from a locked position towards an unlocked position;

said inner surface of said first side having a plurality of receptacles coupled thereto, each of said receptacles having a panel extending from said inner surface of said first side towards said open top of said container at an acute angle with respect to a plane extending along said first side, each of said receptacles having a pair of generally triangular sidewalls extending between said first side and said panel;

a rack being disposed in said interior of said container, said rack having a plurality of first bars extending between said front and back sides of said container and a plurality second bars extending generally perpendicularly to said first bars, said rack being adapted for helping keep said rolls of wrapping paper organized;

said bars of said rack defining a plurality of apertures, a first portion of said apertures being a first size, a second portion of said apertures being larger than said first apertures, a third portion of said apertures being larger than said second apertures;

said bottom having a plurality of wheels extending therefrom;

each of said inner surfaces of said first and second sides having a support flange extending therefrom;

a tray member being removably disposable in said interior of said container and resting on said support flanges of said first and second sides;

said tray member having forward and rearward sides and a pair of ends extending between the forward and rearward sides;

said tray having a cross member extending between said forward and rearward sides and being positioned centrally between said ends, said cross member having an elongate handle slot extending therethrough;

said forward and rearward sides of said tray member having a plurality of alternating ridges and slots;

said tray member having a plurality of spacers being slidably received in said slots of said forward and rearward sides of said tray member;

a tape dispenser being removably disposed in said tray member; and a ribbon dispenser being removably disposed in said tray member, said ribbon dispenser having a plurality of ribbon dispensing slots extending through an upper surface thereof, said ribbon dispenser having an interior and a plurality of rolls of ribbon being disposed in said interior of said ribbon dispenser, said ribbon being extended through said ribbon dispensing slots.

* * * * *